US005862822A

United States Patent [19]

Borders et al.

[11] Patent Number: 5,862,822

[45] Date of Patent: Jan. 26, 1999

[54] CLEANING DEVICE FOR BUFFING PADS AND THE LIKE

[75] Inventors: Phillip Borders, La Mirada, Calif.; Craig A. Achenbach, Davisburg; Richard A. Robb, West Bloomfield, both of Mich.

[73] Assignee: Herkules Equipment Corporation, Walled Lake, Mich.

[21] Appl. No.: 796,985

[22] Filed: Feb. 8, 1997

Related U.S. Application Data

[63] Continuation of Ser. No. 331,884, Oct. 31, 1994, abandoned.

[51] Int. Cl.[6] ..... B08B 3/02; B08B 7/04

[52] U.S. Cl. ..... 134/102.1; 134/139; 134/147; 134/157; 134/200

[58] Field of Search ..... 134/102.1, 157, 134/138, 139, 200, 57 R, 147, 141, 95.1; 15/300.1

[56] References Cited

U.S. PATENT DOCUMENTS

| | | | |
|---|---|---|---|
| 2,592,117 | 4/1952 | Chadwick | 134/141 |
| 3,116,745 | 1/1964 | Burning | 134/158 |
| 4,132,567 | 1/1979 | Blackwood | 134/102.3 |
| 4,226,642 | 10/1980 | Baran | 134/10 |
| 4,354,514 | 10/1982 | Sundheimer et al. | 134/152 |
| 4,521,255 | 6/1985 | Raymor et al. | 134/33 |
| 4,759,384 | 7/1988 | Kliewer | 134/157 X |
| 4,895,177 | 1/1990 | Niblett et al. | 134/40 |
| 4,960,142 | 10/1990 | Robb et al. | 134/157 X |
| 5,193,561 | 3/1993 | Robb et al. | 134/200 X |
| 5,213,117 | 5/1993 | Yamamoto | 134/102.2 |
| 5,213,177 | 5/1993 | Yamamoto | 134/58 R |
| 5,331,987 | 7/1994 | Hayashi et al. | 134/200 X |
| 5,401,328 | 3/1995 | Schmitz | 134/200 X |
| 5,421,883 | 6/1995 | Bowden | 134/95.2 |

*Primary Examiner*—Robert Warden
*Assistant Examiner*—Saeed Chaudhry

[57] ABSTRACT

A device for cleaning a buffing pad comprising: a housing; a turbine wheel means, in the housing for supporting the pad and for rotating the pad in fluid to remove debris therefrom and in air to dry same.

19 Claims, 6 Drawing Sheets

CLEANING DEVICE FOR BUFFING PADS AND THE LIKE

This application is a continuation of application Ser. No. 08/331,884, filed Oct. 31, 1994 now abandoned.

BACKGROUND AND SUMMARY OF THE INVENTION

The present invention generally relates to a cleaning device and, more specifically, to a device for cleaning buffing and polishing pads of different types including those made from wool and/or foam.

A buffing pad is used to provide a finish to the surface of a painted object such as a vehicle (car, boat, plane, etc.) or related part. In the past, such buffing pads have either been thrown away after use or cleaned in an inefficient and laborious manner. It is an object of the present invention to provide an improved apparatus for cleaning such pads. As an example in the prior art the pad(s) was cleaned by scraping off debris with a wire brush, washed by hand or in a standard or commercial household washing machine and dried in a standard household or commercial dryer. Some other prior units clean the pad while it is still attached to a hand held buffing tool such as a motor powered by compressed air or electricity. In this unit the operator inserts the pad into a bucket filled with cleaning solution and activates the tool. As can be appreciated it is dangerous to clean the pad while attached to an electrically powered tool. Further, any tool that must be hand held during cleaning of the pad(s) wastes time and is potentially harmful to the operator.

Accordingly, the invention comprises: a device and method for cleaning a pad comprising: a housing for holding a liquid; first means for supporting and for rotating the pad within the liquid to remove debris therefrom. More specifically, the pad is supported on a rotatable shaft and is cleaned as it rotates in cleaning solution. Positioned near the front face (and optionally the rear face) of the pad is an aerating tube, fed by compressed air, which agitates the cleaning solution to enhance the cleaning of the pad as it rotates. When the cleaning solution is removed from the housing the compressed air directly impinges on the pad reducing drying time. The pad can also be dried simply by rotating the pad in ambient air in the work chamber or in combination with the impinging compressed air.

Many other objects and purposes of the invention will be clear from the following detailed description of the drawings:

DETAILED DESCRIPTION OF THE DRAWINGS

Figure 1:
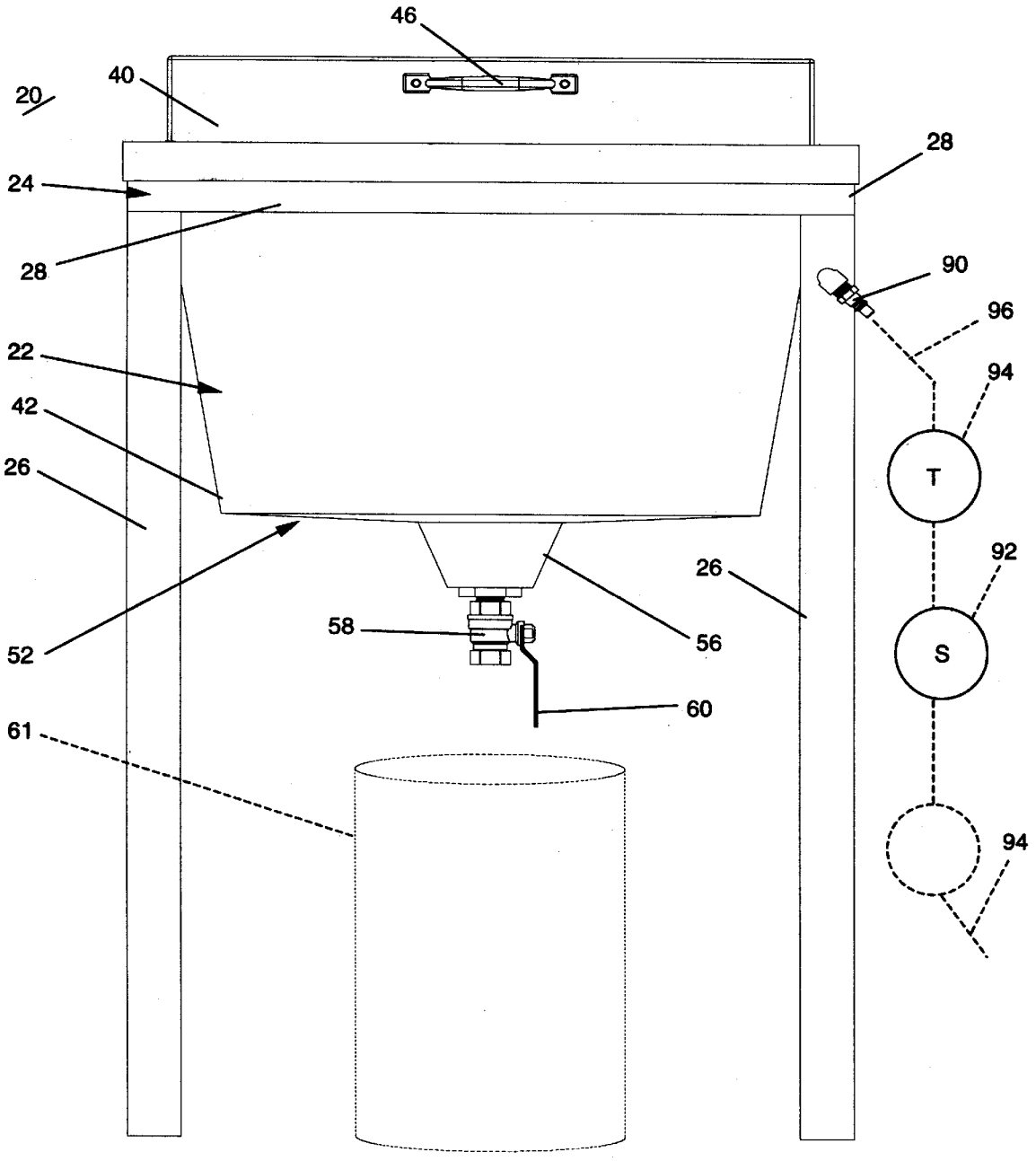
FIG. 1 shows a front view of the present invention.
Figure 2:
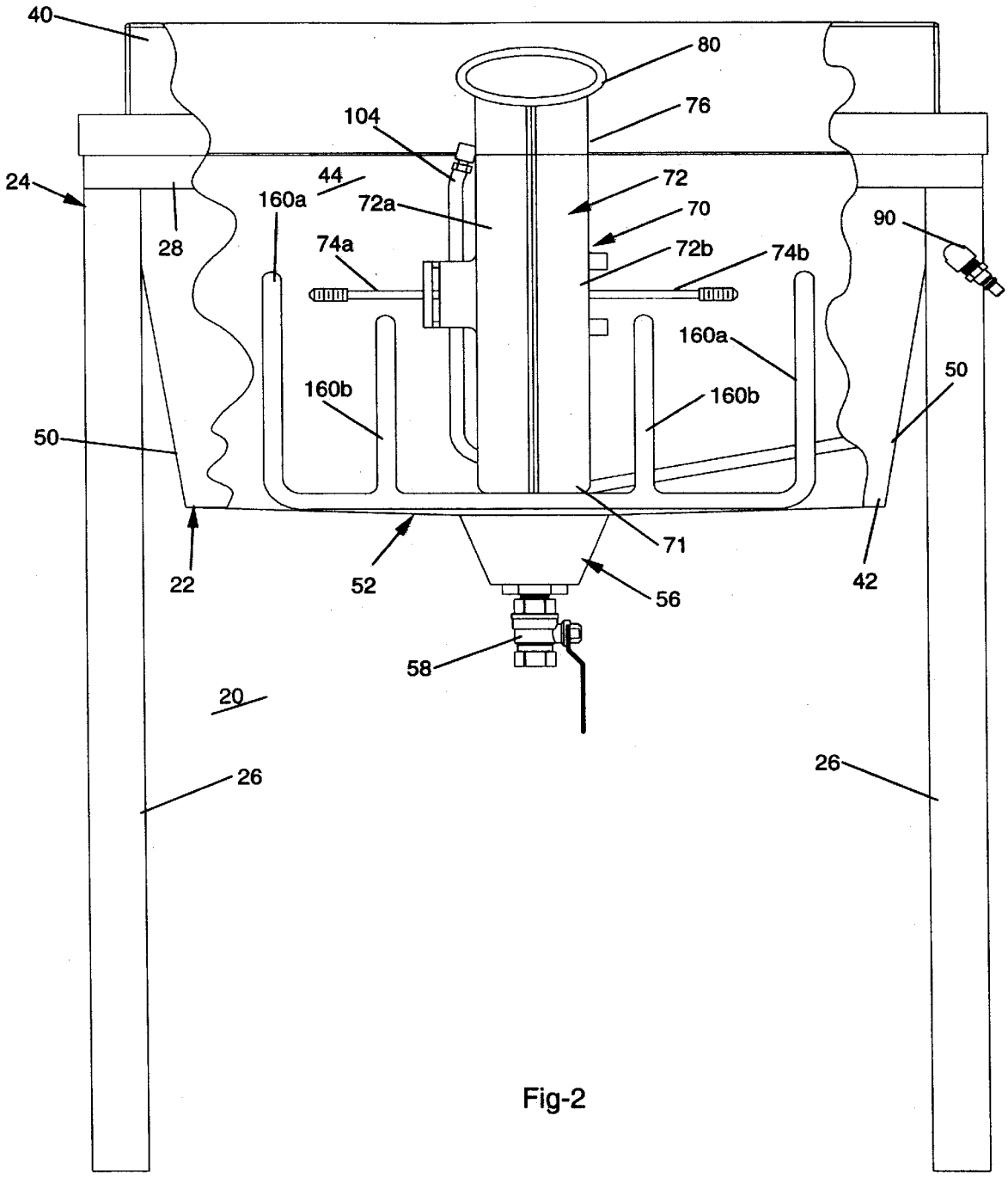
FIG. 2 is a cut-away view showing the location of may components in the housing.
Figure 3:
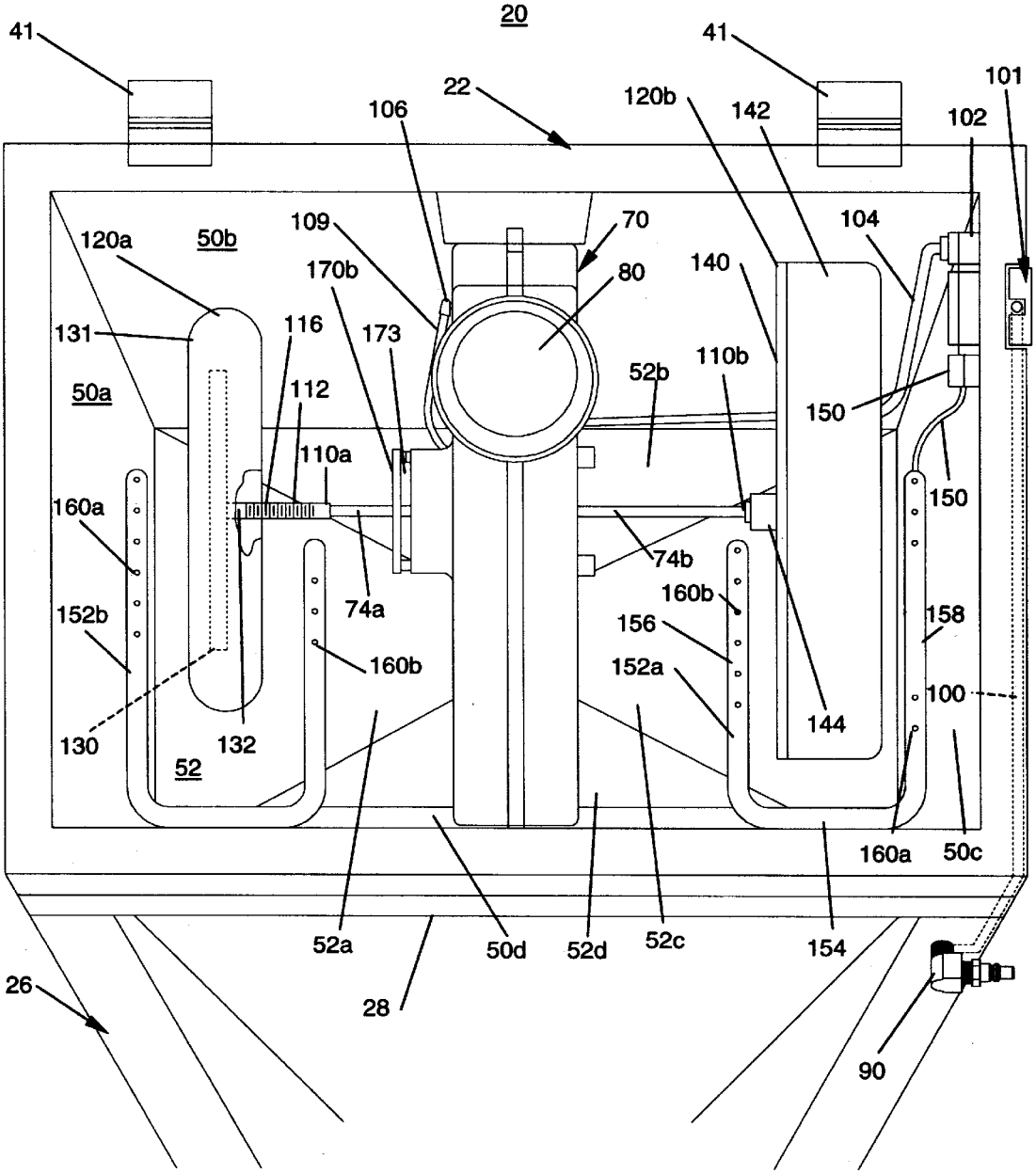
FIG. 3 illustrates a top plan view (with a cover removed) showing many of the major features of the present invention.
Figure 4:
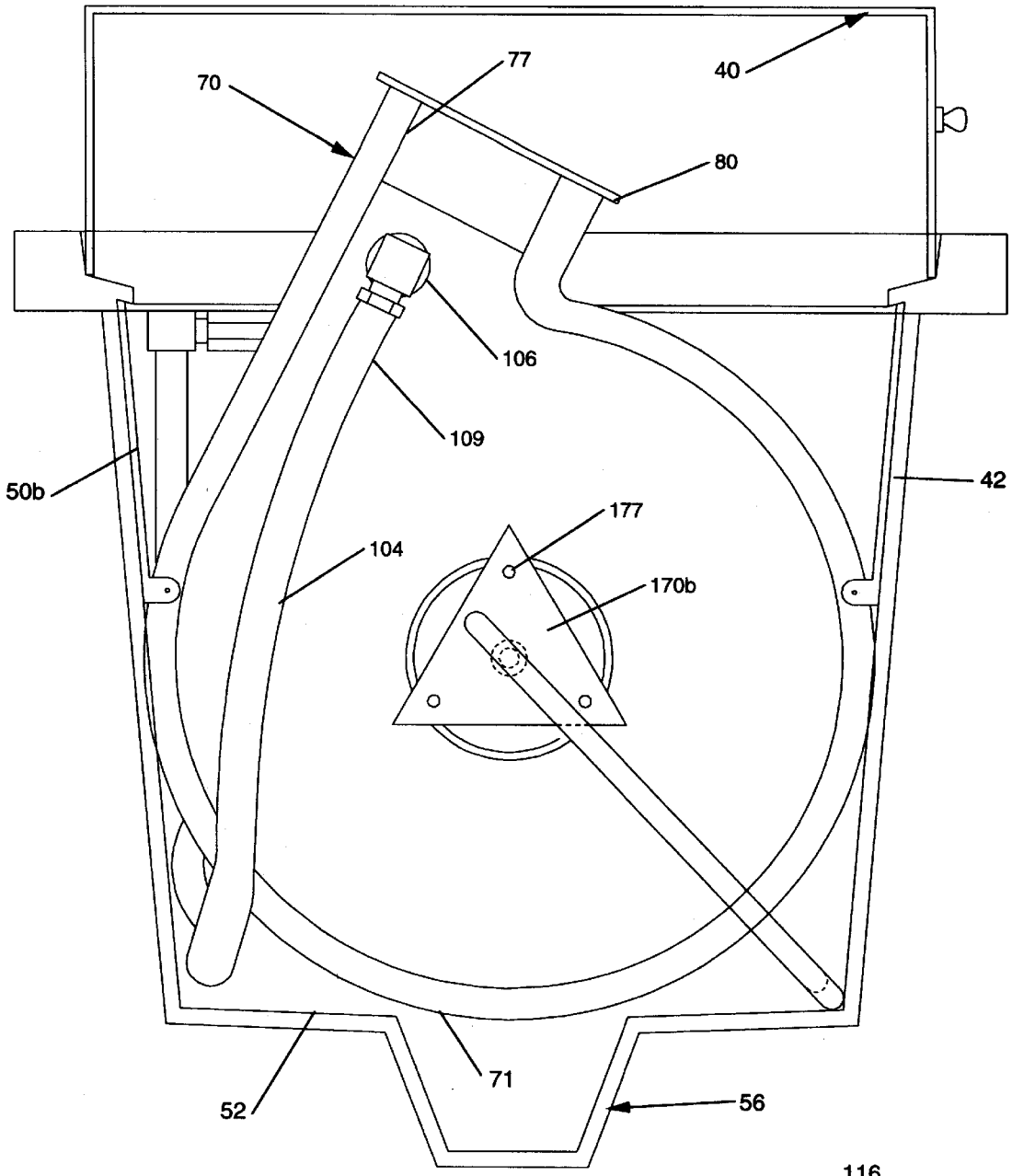
FIG. 4 is a side plan view of a blower motor.

FIGS. 1 through 3 show many of the major components of a cleaning system generally shown as 20. The system includes a housing 22 supported by an optional support member 24 having a plurality of legs 26 and an upper support collar 28 into which the housing is received. The housing 22 comprises a cover 40, having hinges 41, and a tub 42. In combination the cover 40 and tub 42 define a work chamber generally shown as 44 (see FIG. 2). The cover 40 may include a handle 46 to provide easy access to the work chamber. The tub 42 includes four sloping walls or sides 50*a–d,* giving the tub an inverted pyramid-type shape. The four walls 50*a*–50*d* are visible in FIG. 3. The tub 42 includes a lower tub section 52 which is itself sloped having four walls or side sections 52*a*–52*d*. Situated at the center of the lower tub section 52 is a lower bottom section 56. A manually operable drain valve 58 extends from the bottom tub section 56. Fluid within the work chamber 44 may be removed by turning the handle 60 opening the drain valve permitting the liquid to flow into a container such as a five gallon container generally shown in phantom line as numeral 61.

Situated within the work chamber and secured to one of the side walls, such as 50*b*, is an air blower or air blower motor generally shown as 70. The bottom 71 of the blower 70 is spaced from the bottom 52 of the tub. For purposes of reducing the cost of the system, a convention air blower motor, with certain modifications for use in the present invention is employed, though used in a manner different than its normal mode of operation. In the normal operation of the selected blower motor 70 its shaft such as 74 is rotated by a motor. Blades push pressurized air out of the blower exit port generally shown as 76. In the present invention a cap 80 seals the exit port 76 of the blower 70. As will be shown below the present invention, in one embodiment, injects compressed or pressurized air into the blower motor 70 in the vicinity of its closed exit port.

Figure 7:
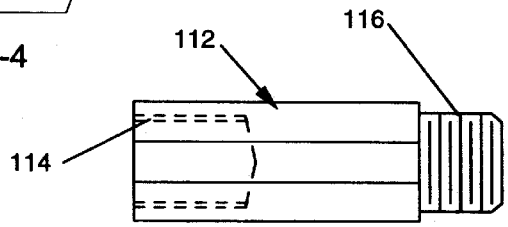
FIG. 7 illustrates an adapter designed to fit upon the threaded shaft end.
Figure 8:
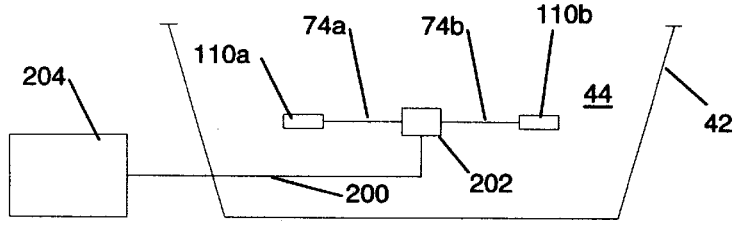
FIG. 8 illustrates an alternate embodiment of the invention.
Figure 6:
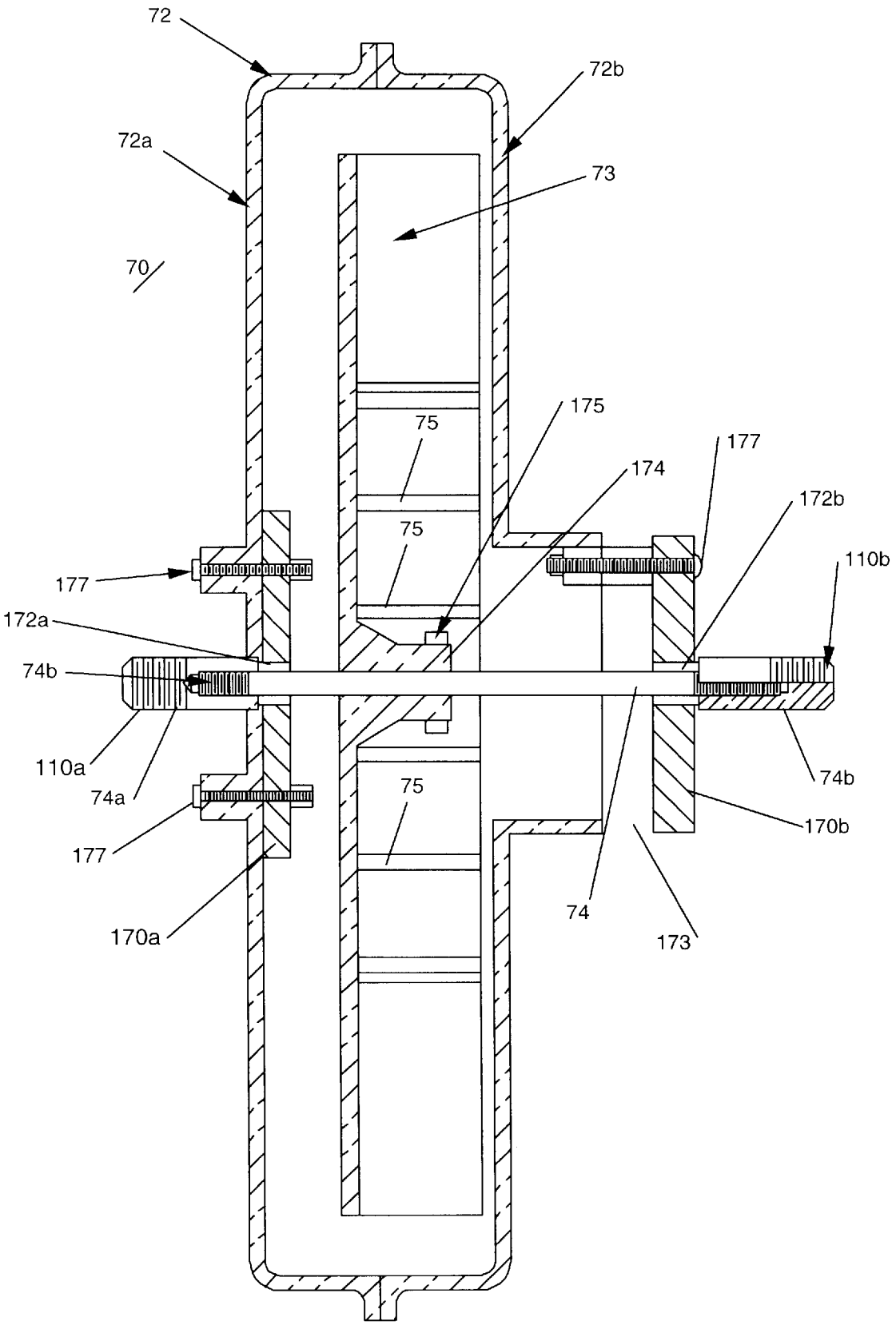
FIG. 6 shows a cross-sectional view of the blower motor.

The blower or blower motor 70 includes a housing 72 having a plurality of mated or joined housing sections 72*a* and 72*b* which are also shown in FIG. 6. The blower motor 70 includes a rotationally supported turbine wheel or paddle wheel 73 having a plurality of vanes or blades 75. Extending through the housing 72, attached to, rotatable with, and supporting the turbine 73 is a shaft 74 having a first shaft section 74*a* extending through housing section 72*a*. Extending through housing section 72*b* is a second shaft section 74*b*. Each end of the shaft sections 74*a* and *b* includes a threaded portion 110*a* and 110*b*. To accommodate pads having coupling connectors or threads of the pad that do not match the threads on portions 110*a* and 110*b*, the invention includes a threaded adapter (see FIG. 7) generally shown as 112 having a threaded bore 114 and threaded end 116 having external threads specific to the threads of the connector internal to the pad to be cleaned. The adapter 112 fits upon one of the threaded ends such as 110*a*. In the alternate embodiment of FIG. 8, the pads are connected directly to the shaft 74. The shaft is rotated via a drive shaft 200 through a gear unit 202. The drive shaft is sealed at the housing. The power to rotate the drive shaft is located external to the housing and can include and electric motor, a fluid driven motor or air driven motor all of which are generally shown as 204. While not shown it is to be understood that the aerating tubes 160*a* and 160*b* may be employed in this embodiment as well.

Figure 5:
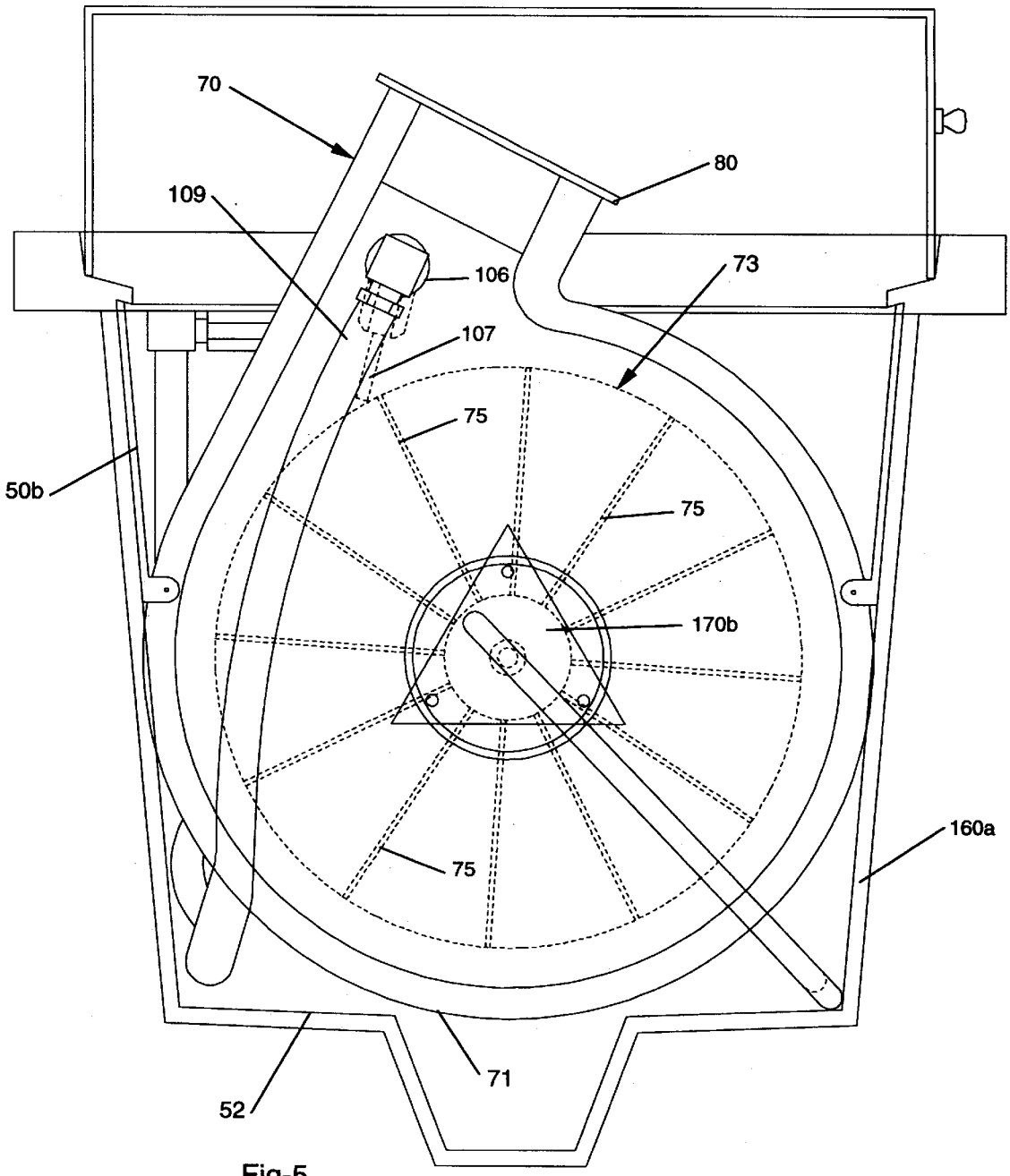
FIG. 5 is a sectional view of the blower motor.

Reference is briefly made to FIGS. 5 and 6 which illustrate cross-sectional views of the blower 70 showing the joined housing parts 72*a* and 72*b* with the turbine 73 rotationally supported upon reinforced side plates 170*a* and 170*b* in bushings 172*a* and 172*b* provided thereon. Side plate 170*a* butts against housing section 72*a* while plate

170*b* is spaced, using spacers 175, from housing section 72*b* to provide an air flow area 173 for air to exit from the blower 70. The plates are secured by fasteners 177. The shaft 74 is fixedly connected to the center portion 174 of the turbine 73 by a ring clamp 175.

In the preferred embodiment of the invention, the blower 70 is rotated by compressed air generally received at an air inlet port 106 connected in the general area of what was the blower exit port 76. As can be seen in FIG. 5 a nozzle 107 is provided to inject the pressurized or compressed air upon each blade.

The compressed air is generated by a source 92 such as a compressor or a pressurized vessel (not shown). A pneumatic timer 94 may be placed within an inlet air feed line 96 such that after a period of time, the timer closes the feed line preventing pressurized air from entering the inlet 90. Alternatively, the timer may be electrical (which is shown generally by phantom line and by numeral 94) in which case the timer is used to turn off the electric motor which typically drives the compressor 92. An air line 100 connects the inlet 90 to a shut off switch 101, comprising an air coupling 102. Pneumatic shut off switches are known in the art. The shut off switch is mounted on a lip of the tub 42 and includes a portion that interacts with the cover 40 such that when an operator opens the cover the system is rendered inoperative by prohibiting the flow of compressed air to the work chamber and air blower. Extending from the coupling 102 is air feed line 104. One end such as 109 of line 104 communicates pressurized air into the blower housing 72*b* via the nozzle 107.

As shown in FIG. 3 a first buffing pad generally shown as 120*a* is fitted to the adapter 112. Fitted to the threaded end 110*b* is another buffing pad 120*b*. As is known in the art, there exist various pads of different construction. Pad 120*a* is illustrative of a pad having a central support core 130, covered by buffing pad material 131, and which also includes an interior threaded bore 132. In such a pad, the threaded bore is received upon the external threads of the adapter 116. Of course, if the threads on the pad fit those on the shaft the adapter 116 will not be used. As an example, this pad 120*a*, may use wool or some other material as the buffing material. The other pad 120*b* includes a rigid back 140. Extending from the back is foam or rubber generally shown as 142. Extending from the back 140 is a coupling 144 that is threaded upon the threaded end portion 110*b*.

Reference is again made to the air coupling 102. Extending from this coupling is another air tube 150. The tube 150 is connected to two (2) U-shaped drying and aerating tubes 152*a* and 152*b*. Each tube includes a central part 154, an opposed short leg 156 and a long leg 158. The legs 156 and 158 include a plurality of openings such as 160*a* and 160*b*, facing each other the purpose of which will be described below. In operation, the previously-used dirty buffing pads 120*a* and 120*b* are mounted upon the threaded ends of the shaft portions 74*a* and *b* or the adapter 112 if used. The threaded ends of the shaft section 110*a* and b as well as end of the adapter 116 may be reverse threaded, in relation to the relative rotational direction of the shaft 74, to prevent the buffing pads from loosening and becoming dislodged as the blower rotates.

It has been found that one efficient and economic way to clean the buffing pads is to first wash them in a detergent and then dry and/or rinse them. After the buffing pads are mounted to the respective shaft portions 74*a* and 74*b*, cleaning solvent, such as a combination of soap and water, is placed within the tub. Of course, the solvent can be resident in the housing prior to use. Thereafter the cover 40 is lowered and compressed air is supplied to the inlet 90. The compressed air flowing through tube 104 enters the blower 70 causing the shaft 74 to rotate. In turn, the pads 120*a* and b mounted to the shaft rotate within the cleaning solution. The compressed air blown through tube 150 enters the two (2) U-shaped drying/aerating tubes 152*a* and 152*b*. As can be seen, the legs 156 and 158 of these tubes 152*a* and 152*b* surround the cleaning pads. While not shown the tubes may be supported in a desired orientation relative to the pads by one or more brackets. The tubes can be mounted radially (see FIG. 5) relative to the pads or mounted vertically or horizontally. The compressed air exiting the openings 160*a* and b creates a turbulence in the cleaning solution proximate the buffing pads which enhances the ability of the system 20 to clean the pads. While the turbulent effect is enhanced by using the opposed aerating tubes only a single tube having openings directed toward the face of the pad will suffice. It has been found that most pads can be satisfactorily cleaned by operating the system as described for about seven to eight minutes. Thereafter, the drain 58 is opened to remove the cleaning solution. Once the cleaning solution has been drained from the tub 42, the blower is permitted to continue to operate in which case the continued rotation of the pads causes any residual cleaning solution to be thrown therefrom. With the continued application of compressed air, such air continues to flow through the openings 160*a* and 160*b*. With the cleaning solution removed from the tub 42, the air exists these openings 160*a* and b and is directed against the exterior surfaces of the pads 120*a* and b drying same. The close proximity of the openings 160*a* and b to a pad having a fibrous or shag covering, such as one comprised of wool or other synthetic material, and the turbulence created by the air flow fluffs up the pad rather then permitting it to mat down as happens with prior systems. If a matted pad is used to finish a surface it tends to scratch or burn the surface causing additional and expensive rework. If needed the tub may again by filled with a rinsing solution prior to the drying phase of operation. Additionally, installation of a valve in air line 150 will permit the pad to by dried by using only the ambient air in the work chamber as air flow to the aerating tubes will be halted.

Many changes and modifications in the above described embodiment of the invention can, of course, be carried out without parting from the scope thereof. Accordingly, that scope is intended to be limited only by the scope of the appended claims.

We claim:

1. A device for cleaning at least one buffing pad, the pad having a fluffy, airy condition prior to use and which becomes matted down when used to buff a surface comprising:

a housing having liquid therein at a level sufficient to cover a part of the pad to be cleaned;

first means for rotating the pad in the liquid to remove debris from the pad;

second means for introducing air under the level of the liquid, while the pad is rotating, to permit the liquid to deeply penetrate into the pad material to enhance the cleaning of the pad material;

third means for removing the liquid from the housing; and fourth means for introducing air upon the rotating pad, subsequent to the removal of the liquid from the housing, to quicken the drying time of the pad and to fluff up the pad so that is not matted down after being dried.

2. The device as defined in claim 1 wherein a single source of compressed air provides a means for powering the first means to rotate the pad and a means for creating the turbulence within the liquid.

3. A device for cleaning and drying at least one buffing pad comprising:

a housing having liquid therein; first means for rotating the pad in the liquid to remove debris from the pad and for rotating the pad in air, subsequent to the removal of the liquid from the housing for drying the pad, wherein the first means includes one of; a turbine wheel, a paddle wheel, and a rotatable shaft and connector means for connecting the pad to one of the turbine wheel, paddle wheel and the shaft;

wherein the pad is mounted to the first means in a substantially perpendicular orientation to a rotary axis of the first means and wherein the first means includes a source of compressed air for causing one of the shafts turbine wheel and paddle wheel to rotate.

4. A device for cleaning and drying at least one buffing pad having material thereon forming a buffing surface comprising:

a housing having liquid therein; first means for rotating the pad in the liquid to remove debris from the pad and for rotating the pad in air, subsequent to the removal of the liquid from the housing for drying the pad;

and at least one air outlet for directing air, during drying, upon the pad, wherein the pad is mounted upon the first means substantially perpendicular to a rotary axis of the first means.

5. The device as defined in claim 4 wherein the housing includes drain means for emptying the liquid from the housing.

6. The device as defined in claim 4 wherein the first means is selected from the group consisting of: a turbine wheels paddle wheel, and a rotatable shaft and connector means for connecting the pad to one of the turbine wheel, paddle wheel and the shaft.

7. The device as defined in claim 6 wherein the first means includes an air blower motor.

8. The device as defined in claim 6 including means for providing pressurized air for causing the turbine to rotate.

9. The device as defined in claim 4 including second means, proximate the pad for agitating the liquid near at least one side of the pad to enhance the cleaning of same and a source of compress air, wherein such source of compressed air is communicated to the second means and to the first means for powering the first means to rotate the pad within liquid and to provide turbulence within the liquid about the pad, said second means including a plurality of air outlets for directing air, during drying subsequent to removal of the liquid, upon the pad.

10. The device as defined in claim 9 wherein the second means includes at least one aerating tube having air forced therethrough, wherein the air exiting the tube causes agitation of the liquid.

11. The device as defined in claim 10 wherein the aerating tube is U-shaped having legs on opposing sides of the pad.

12. The device as defined in claim 4 wherein the housing includes a tub and a cover.

13. The device as defined in claim 12 wherein the housing includes a shut down switch activated by opening of the cover to shut down the operation of the device.

14. The device as defined in claim 4 including timer means operatively connected to the first means for stopping the operation of the first means after a predetermined period of operation.

15. The device as defined in claim 4 wherein the liquid is one of: cleaning solution, rinsing solution, and air.

16. The device as defined in claim 4 includes power means for rotating the first means wherein the power means is located outside of the housing.

17. The device as defined in claim 4 wherein the first means includes at least two shafts, each shaft including means for receiving a respective pad to be cleaned, each pad rotatable within the liquid and in air to be subsequently dried.

18. The device as defined in claim 17 wherein the shafts extend oppositely relative one to the other.

19. A device for cleaning and drying at least one buffing pad having material thereon forming a buffing surface comprising:

a housing having liquid therein; first means for rotating the pad in the liquid to remove debris from the pad and for rotating the pad in air, subsequent to the removal of the liquid front the housing for drying the pad; and;

a plurality of air outlets for directing air, during drying, upon the pad in a direction substantially perpendicular to the pad.

* * * * *